US007771543B2

(12) United States Patent
Bang

(10) Patent No.: US 7,771,543 B2
(45) Date of Patent: Aug. 10, 2010

(54) LEAKAGE PREVENTING STRUCTURE OF DISH WASHER

(75) Inventor: Jong Chul Bang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 446 days.

(21) Appl. No.: 10/568,221

(22) PCT Filed: Jun. 7, 2005

(86) PCT No.: PCT/KR2005/001690

§ 371 (c)(1),
(2), (4) Date: Feb. 14, 2006

(87) PCT Pub. No.: WO2006/001610

PCT Pub. Date: Jan. 5, 2006

(65) Prior Publication Data

US 2008/0163903 A1 Jul. 10, 2008

(30) Foreign Application Priority Data

Jun. 24, 2004 (KR) ..... 10-2004-0047446
Jun. 24, 2004 (KR) ..... 10-2004-0047447

(51) Int. Cl.
*B08B 3/00* (2006.01)

(52) U.S. Cl. ..... 134/57 D; 134/56 D; 134/58 D; 134/141; 134/184

(58) Field of Classification Search ..... 134/56 D, 134/57 D, 58 D, 141, 184
See application file for complete search history.

(56) References Cited

U.S. PATENT DOCUMENTS

| | | | | |
|---|---|---|---|---|
| 3,963,046 | A | 6/1976 | Bergeson | |
| 4,612,947 | A | 9/1986 | Duncan | |
| 5,450,868 | A * | 9/1995 | Young, Jr. | 134/111 |
| 5,624,245 | A | 4/1997 | DeClerck | |
| 5,855,472 | A * | 1/1999 | Ravitts | 417/421 |
| 5,909,743 | A | 6/1999 | Thies et al. | |
| 6,367,811 | B1 * | 4/2002 | Hosokawa et al. | 277/560 |
| 6,384,508 | B1 | 5/2002 | Marioni | |
| 6,659,243 | B2 * | 12/2003 | Yasuda | 188/322.17 |
| 2003/0168087 | A1 * | 9/2003 | Inui et al. | 134/57 D |

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

A leakage preventing structure of a dishwasher is provided. The structure includes a wash motor with a motor shaft disposed at its center, a sump housing that the motor shaft passes through, and a sealing portion that seals the space between the wash motor and the sump housing. The sealing portion is an aircap that controls the water level of washing water introduced into the aircap by means of air pressure of air inside the aircap, or a sealing member coupled to the motor shaft of the wash motor.

5 Claims, 5 Drawing Sheets

[Fig. 1]
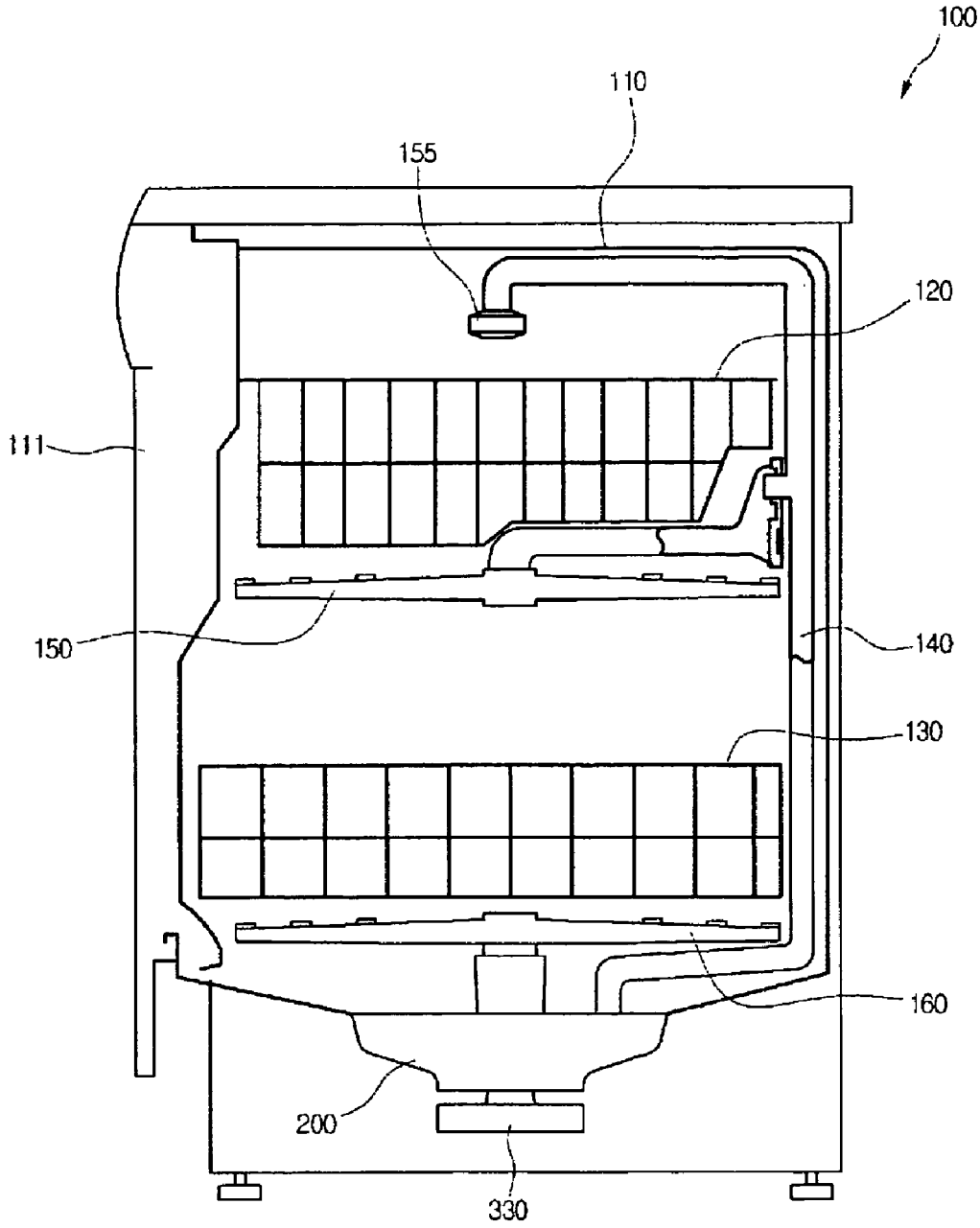

[Fig. 2]
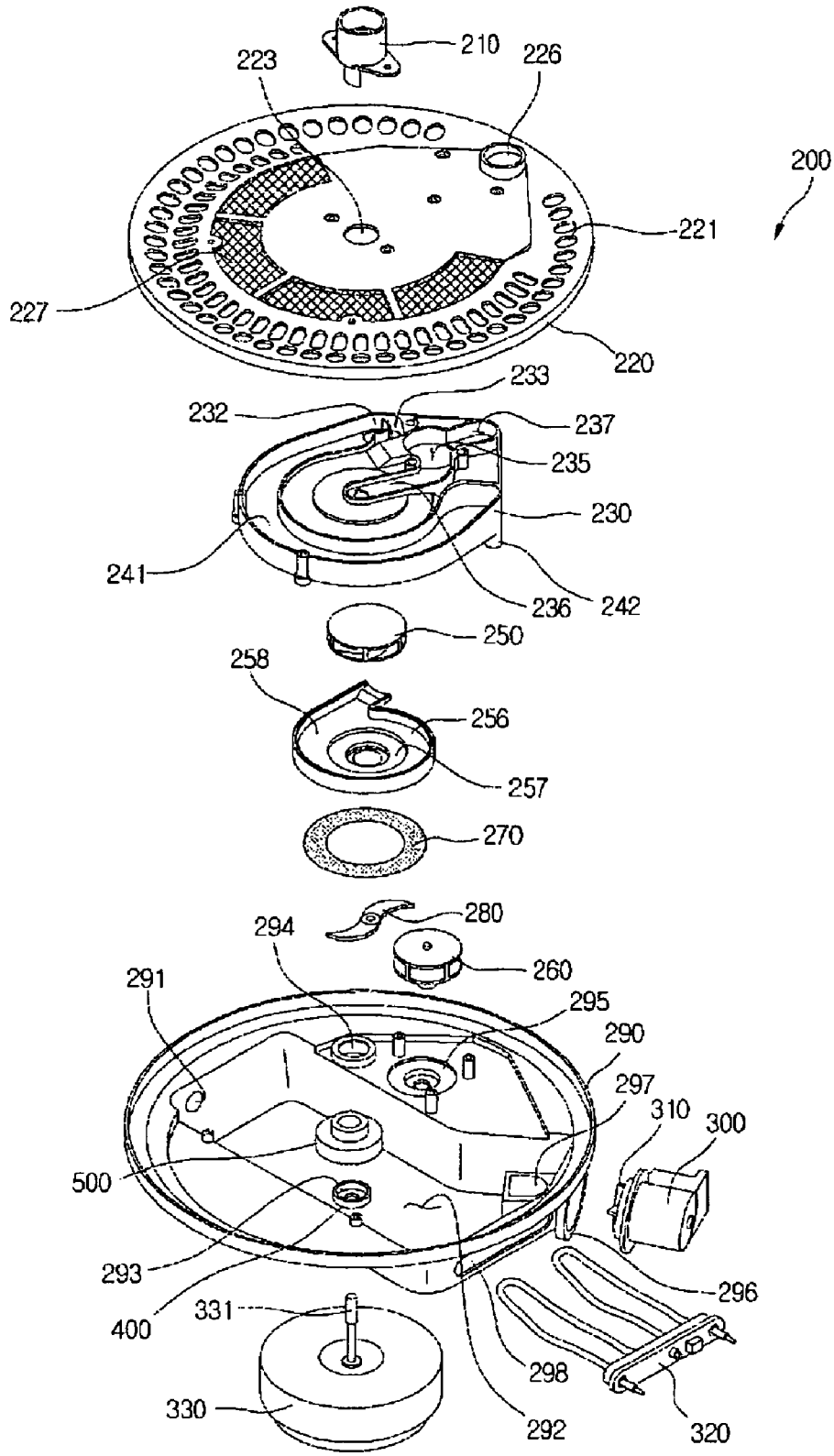

[Fig. 3]
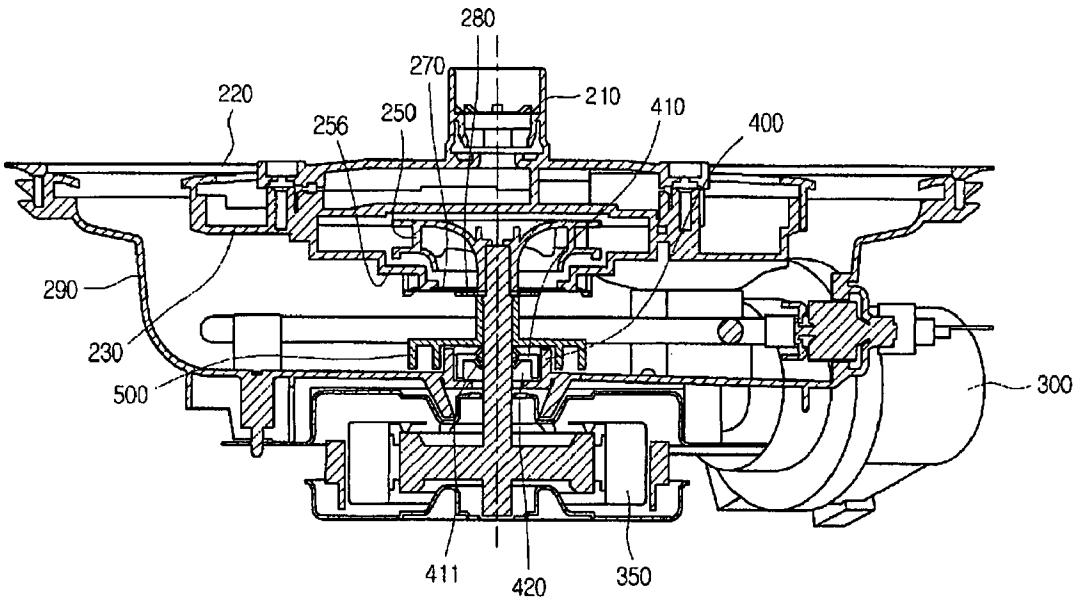
[Fig. 4]
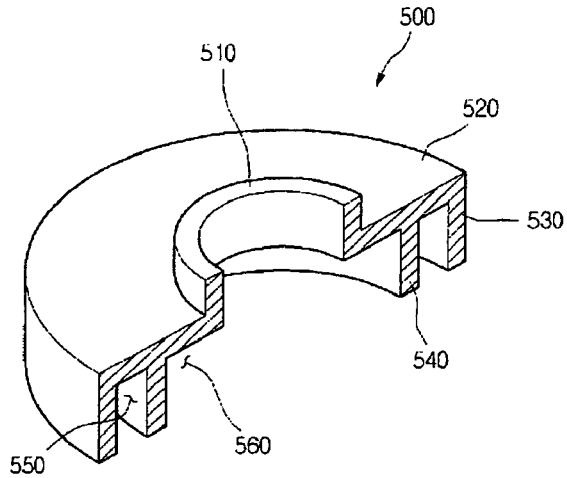

[Fig. 5]
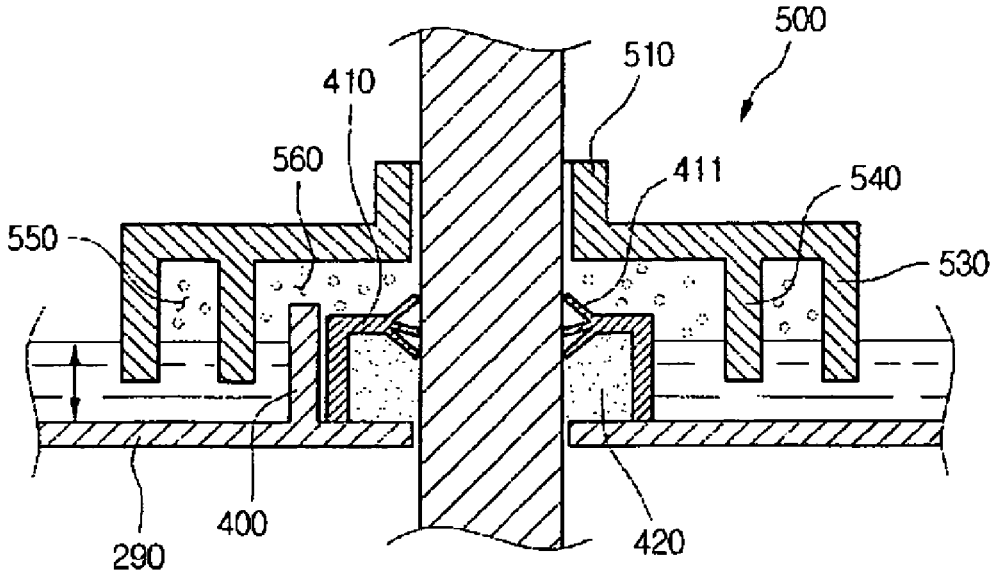
[Fig. 6]
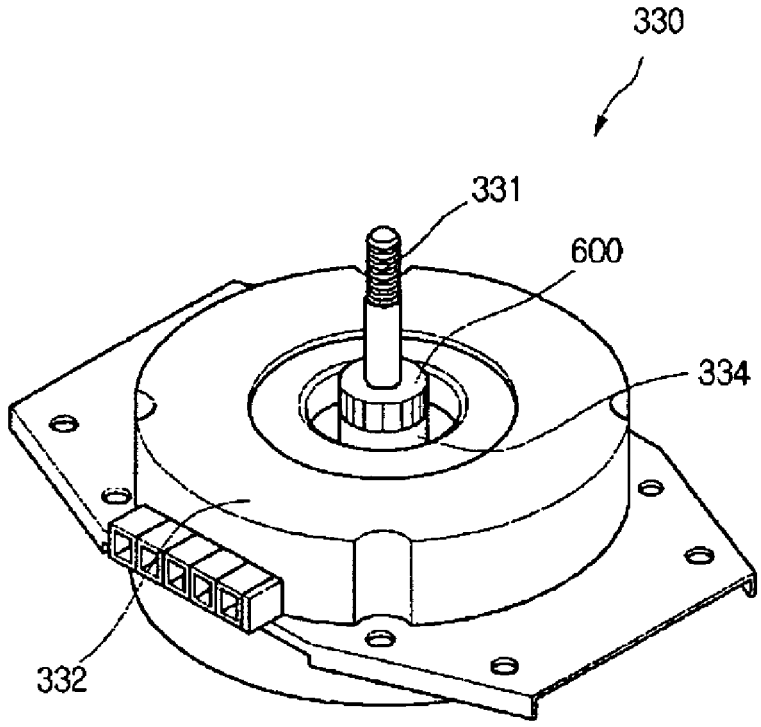

[Fig. 7]
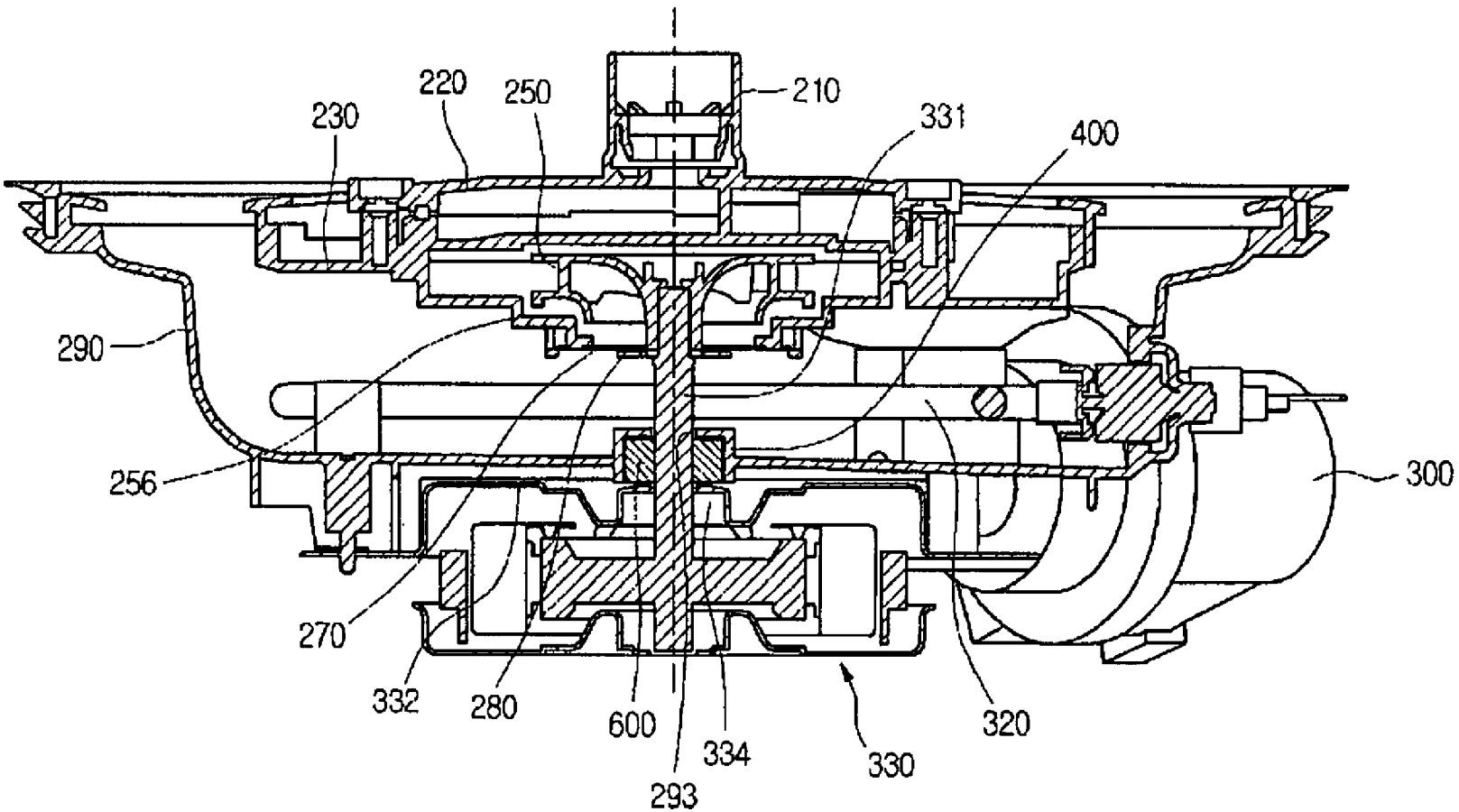

LEAKAGE PREVENTING STRUCTURE OF DISH WASHER

This application claims the benefit of Korean Patent Application No. 2004-0047447, filed on Jun. 24, 2004; Korean Patent Application No. 2004-0047446, filed Jun. 24, 2004 and PCT Application No. PCT/KR2005/001690, filed on Jun. 7, 2005, which are hereby incorporated by reference for all purposes as if fully set forth herein.

TECHNICAL FIELD

The present invention relates to a dishwasher, and more particularly, to a leakage preventing structure of a dishwasher, which can prevent washing water stored in a sump from leaking out through a through-hole for a motor shaft.

BACKGROUND ART

A dishwasher is one of home appliances that can remove food particles from dishes using high-pressure washing water sprayed from nozzles.

To be specific, a dishwasher includes a tub forming an interior space in which dishes to be washed are placed, a sump mounted under the tub to store washing water, a wash pump attached to one side of the sump to pump the washing water contained in the sump to spraying nozzles, a wash motor for driving the wash pump, a drain pump for draining dirty washing water after the washing has been completed, and a drain motor for driving the drain pump.

The wash pump is installed inside the sump and the wash motor is installed below the sump, so that the wash motor and the wash pump are perpendicularly coplanar. Specifically, the shaft of the wash motor in the above configuration passes through into the sump and is coupled directly to the pump. An impeller inside the pump rotates according to the rotation of the motor shaft, thereby pumping washing water.

Here, when the motor shaft is inserted through the bottom of the sump, washing water runs down the outer surface of motor shaft during its rotation and leaks out from the sump.

While the motor shaft rotates, friction created between the shaft and the sump wears and reduces the effectiveness of the sealing function between the motor shaft and the sump. When a gap is created in the motor shaft through-hole between the motor shaft and the sump, washing water can leak through the gap.

Also, when the fixture of a sealing member to the sump precludes the installation of the motor, the surface of the sealing member can be damaged in the installation process and washing water can leak out.

DISCLOSURE OF INVENTION

Technical Problem

An object of the present invention is to provide a leakage preventing structure of a dishwasher capable of preventing washing water stored in the sump from leaking out along an outer surface of a motor shaft.

Another object of the present invention is to provide a leakage preventing structure of a dishwasher with an improved seal assembly method and process that can prevent incurring damage to the sealing member during its assembly.

Technical Solution

To achieve these objects and other advantages and in accordance with the purpose of the invention, as embodied and broadly described herein, a leakage preventing structure of a dishwasher according to the present invention includes: a wash motor with a motor shaft at its center; a sump housing allowing insertion therethrough of the motor shaft; and a sealing portion for sealing the gap between the wash motor and the sump housing.

The sealing portion may be an aircap for controlling the water level of washing water that enters the aircap, via air pressure therein, or a sealing member coupled to the wash motor shaft.

Advantageous Effects

The leakage preventing structure of a dishwasher according to the present invention prevents washing water from leaking out along an outside of a motor shaft.

More specifically, a sealing cover installed in a sealing case of the motor shaft and a sealing oil primarily prevents a washing water from leaking out, and an aircap covering the sealing cover secondarily prevents washing water from leaking out toward the sealing cover.

Additionally, after a sealing member for preventing washing water leakage is coupled to the motor shaft, the motor is installed on the sump, so that no damage is incurred to the sealing member during installation.

BRIEF DESCRIPTION OF THE DRAWINGS

FIG. 1 is a schematic sectional view of a dishwasher with a leakage preventing structure according to the present invention;

FIG. 2 is an exploded perspective view of a sump having a leakage preventing structure according to a first embodiment of the present invention;

FIG. 3 is a vertical, sectional view of a sump having the leakage preventing structure according to the first embodiment of the present invention;

FIG. 4 is a cut-away perspective view of the leakage preventing structure according to the first embodiment of the present invention;

FIG. 5 is an enlarged sectional view showing an aircap that is partially immersed in washing water according to the first embodiment of the present invention;

FIG. 6 is a perspective view of a wash motor according to a second embodiment of the present invention; and FIG. 7 is a sectional view of the wash motor of FIG. 6 coupled to a sump housing.

BEST MODE FOR CARRYING OUT THE INVENTION

Hereinafter, preferred embodiments of a leakage preventing structure of a dishwasher according to the present invention will be described in detail with reference to the accompanying drawings. While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

FIG. 1 is a schematic sectional view of a dishwasher with a leakage preventing structure according to the present invention.

Referring to FIG. 1, the dishwasher 100 having the leakage preventing structure of the present invention includes a tub 110 forming the outer shape of the dishwasher 100 and having a dish washing chamber on its inside, a door 111 formed on the front of the tub 110 to open and close the dish washing chamber, and a sump 200 formed at the central bottom portion of the tub 110 for holding washing water.

Moreover, the dishwasher 100 includes a water guide 140 for guiding washing water pumped by a wash pump, a lower nozzle 160 disposed on top of the sump 200 and formed at the bottom of the dish washing chamber for spraying washing water upward, an upper nozzle 150 attached to the upper portion of the water guide 140 and formed to extend perpendicularly from the water guide 140 to the center of the dish washing chamber, and a top nozzle 155 formed on the ceiling portion of the tub 110 for spraying washing water perpendicularly downward.

In order to wash dishes through the upper nozzle 150, an upper rack 120 is installed above the upper nozzle 150. In order to wash dishes through the lower nozzle 160, a lower rack 130 is installed above the lower nozzle 160.

The upper rack 120 is supported by rails (not shown) on the inner sides of the tub 110 and slides forward and backward.

An operation of the dishwasher 100 according to the present invention will be described below.

First, a user opens the door 111 of the dishwasher 100, and pulls the upper rack 120 and/or the lower rack 130 out from the dish washing chamber. Next, the user places dishes on the upper and/or lower racks 120 and/or 130, closes the door 111. When the user presses the power button. the dish washing cycle begins.

When power is supplied to the dishwasher 100 and a wash cycle begins, washing water enters the sump 200. When the sump 200 is filled with washing water, the wash motor 330 operates. When an impeller inside a wash pump (not shown) connected to the shaft of the wash motor spins, washing water is pumped to the lower nozzle 160 and the water guide 140.

The washing water pumped to the water guide 140 moves to the top and upper nozzles 155 and 150 from where it is sprayed into the dish washing chamber. The dishes stacked on the upper and lower racks 120 and 130 are washed by the sprayed washing water.

Here, the top nozzle 155 sprays washing water downward and the upper nozzle 150 sprays washing water upward to wash dishes stacked on the upper rack 120.

The lower nozzle 160 sprays washing water upward to wash dishes stacked on the lower rack 130. Nozzle openings may be formed on the lower portion of the upper nozzle 150 to spray washing water downward as well as upward, in order to simultaneously wash the upper portions of dishes stacked on the lower rack 130.

When the wash cycle is completed, a drain pump (not shown) pumps the dirty washing water in the sump 200 out from the dishwasher 100.

When the dirty washing water is expelled to the outside, clean washing water enters the sump 200 via an intake opening, and is then sprayed in the same manner through the nozzles 150, 155 and 160 as in the wash cycle. Hence, the clean washing water sprays and rinses the dishes.

After the rinse cycle, a dry cycle is carried out. In this manner, the dish washing process is completed.

FIG. 2 is an exploded perspective view of a sump having a leakage preventing structure according to a first embodiment of the present invention.

Referring to FIG. 2, the sump 200 of the dishwasher with the leakage preventing structure according to the present invention includes a-sump housing 290 for storing water drawn through a washing water supply pipe, a wash motor 330 installed below the sump-housing 290, and a disposer 280 connected to the motor shaft 331 protruding from the center of the wash motor 330, for rotating and miniaturizing food particles.

The sump 200 further includes a pump case 256 installed at the top of the disposer 280 for pumping washing water stored inside the sump housing 290, and an impeller 250 inside the pump case 256 for pumping washing water. The impeller 250 has the motor shaft 331 inserted in a central portion thereof, and rotates to pump washing water according to the rotation of the motor shaft 331.

Furthermore, a mesh filter 270 is installed between the disposer 280 and the pump case 256 and filters food particles, which have been miniaturized by the disposer 280 but are still too large, from entering the pump case 256.

A soil chamber 230 covers the top of the pump case 256 and forms a pumping channel that guides the flow of washing water pumped in the pump case 256.

In addition, a filter 220 rests on top of the soil chamber 230 and has a spray nozzle connecting port at an edge of its central portion. The spray nozzle connecting port is connected to the spray nozzles so that washing water pumped along the pumping channel formed by the soil chamber 230 is guided to each spray nozzle. Also, a distribution valve 260 is installed on a side of the soil chamber 230 in order to selectively guide the washing water pumped along the pumping channel to each spray nozzle.

More specifically, a washing water through-hole 221 and a mesh filter 227 are formed at an edge of the filter 220 for filtering food particles washed from dishes in a preliminary filtering stage. An insert hole 223 is formed at the center of the filter 220 for installing a lower nozzle arm holder 210 thereon, to be coupled to the lower nozzle. Also, a water guide insertion sleeve 226 is formed at a predetermined height and diameter on an edge of the filter 220 for inserting the lower end of the water guide 140 therein. The water guide 140 is a □-shaped pipe for guiding washing water pumped by the wash pump 256 from the bottom of the tub to the upper nozzle toward the top of the tub.

A distribution valve housing 235 is formed on a portion of the soil chamber 230 to receive the distribution valve 260. A lower nozzle feed 236 is formed on the top of the soil chamber 230. The lower nozzle feed 236 is bent from the distribution valve housing 235. Also, a water guide feed 237 is formed to guide washing water from the distribution valve housing 235 towards the water guide insertion sleeve 226.

At the periphery of the soil chamber 230, a drain channel 241 is formed to have a predetermined width and depth and constructed in accordance with the soil chamber 230 structure. A turbidity sensor receptacle 232 for receiving a turbidity sensor is formed on one side of the drain channel 241, and a drain hole 242 connected to the drain pump and the lower end of the sump is formed at the bottom of the other side. Here, the turbidity sensor is a sensor installed on one side of the sump for sensing impurities in washing water during a dish washing cycle.

Further, a turbidity sensor guide channel 233 guides washing water pumped in the pump case 256 to the turbidity sensor inserted in the turbidity sensor receptacle 232.

The washing water that descends through the washing water through-hole 221 on the filter 220 is collected in the sump housing 290. The washing water that descends onto the mesh filter 227 has its particle contaminants filtered by the mesh filter 227, then proceeds along the drain channel 241 disposed below the mesh filter 227, and is collected by the sump housing 290.

At a central portion of the pump case 256 is an impeller insertion recess 257 for installing an impeller 250 therein. A pumping channel 258 is formed by the outer circumference of the impeller insertion recess 257 and the outer portion of the pump case 256. The pumping channel 258 has a predetermined depth determined by the outer wall of the pump case 256. Washing water that enters the pump case 256 moves along the pumping channel 258 towards the distribution valve 260.

The sump housing 290 includes a water supply port 291 formed on a lower side thereof, a drain pump case 296 recessively formed roughly opposite to the water supply port 291, and a heater receptacle 292 recessed a predetermined depth at the center of the sump housing 290.

More specifically, at the center of the heater receptacle 292 a motor shaft through-hole 293 is formed for a motor shaft to pass therethrough, and at one side of the sump housing 290 a heater insertion slot 298 is formed for a heater 320 to be inserted therethrough. A cylindrical sealing case 400, which has a diameter larger than the motor shaft through-hole 293 and a predetermined height, is formed above the motor shaft through-hole 293. Inside the sealing case 400, a sealing cover (which will be described later) is inserted around the motor shaft 331 to prevent leakage in a preliminary stage. Furthermore, an aircap 500 is inserted on the outer surface of the motor shaft 331 between the lower end of the pump case 256 and the upper end of the sealing case 400 so as to prevent leakage in a secondary stage. A detailed description of the aircap 500 will be made later.

The drain pump case 296 is connected to the soil chamber drain groove 297, and the drain motor 300 is installed on the drain pump case 296. The drain impeller 310, which spins inside the drain pump case 296 to pump washing water out through a drain hose, is attached to the front of the drain motor 300.

The sump housing 290 has a distribution valve mount 295 formed on a surface outside of the heater receptacle 292, with a turbidity sensor mount 294 formed a pre-determined distance apart from the distribution valve mount 295.

To briefly describe the flow of washing water in the above-described sump structure according to the present invention, the washing water stored in the lower portion of the sump is first suctioned through the rotation of the wash motor 330 towards the impeller 250 installed in the pump case 256. Next, the washing water pumped by the rotation of the impeller 250 flows through the mesh filter 270 and is filtered in a preliminary stage. Subsequently, the washing water flows along the pumping channel 258 formed by the pump case 256 and the soil chamber 230, and respectively flows to the upper and lower nozzles (not shown). Here, the washing water is divided by the distribution valve 260, and respectively flows to the lower and upper nozzles through the lower nozzle feed 236 and water guide feed 237.

More specifically, the distribution valve 260 opens the washing water passage to only one of the upper and lower nozzles 150 and 160 at a given time. After the given time elapses, the passage to the other nozzle is opened, so that washing water is evenly sprayed from the upper and lower nozzles.

A portion of the washing water that flows through the passages passes the turbidity sensor (not shown) and flows along the drain channel 241 formed on the outer portion of the soil chamber 230 to collect at the bottom of the sump. During the draining process, the washing water moves through the drain pump case 296 and is drained through the rotating drain impeller 310 when the drain motor 300 operates.

FIG. 3 is a vertical sectional view of a sump having the leakage preventing structure according to the first embodiment of the present invention, and FIG. 4 is a cut-away perspective view of the leakage preventing structure according to the first embodiment of the present invention.

Referring to FIG. 3, the leakage preventing structure according to the present invention that is the aircap 500 is inserted, as previously described, around the motor shaft between the bottom of the pump case 256 and the sealing cover 410.

The aircap 500 may be installed at the bottom of the disposer 280. Furthermore, the aircap 500 may have a diameter large enough to accommodate the outside of the sealing case 400 therein. The sealing case 400 is a cylinder having a predetermined diameter and height, and has the motor shaft through-hole 293 disposed at its center for inserting the motor shaft 331 therethrough.

A sealing cover 410 is placed inside the sealing case 400. Sealing oil 420 is filled in the space created by the sealing case 400 and the sealing cover 410. Specifically, in order to maintain a sealed state in the space between the sealing cover 410 and the outer surface of the motor shaft 331, a plurality of sealing lips 411 are formed. Accordingly, the sealing lips 411 are pressed firmly against the outside of the motor shaft 331, to prevent washing water from leaking into the sealing case 400. Because sealing oil 420 seals the space formed by the sealing cover 410 and the sealing case 400, if washing water and the sealing oil 420 should meet, they do not mix. Furthermore, the sealing oil 420 also acts as a lubricant for the motor shaft 331.

Referring to FIG. 4, the leakage preventing structure according to the present invention, that is, the aircap 500 includes a circular aircap upper plate 520 having a predetermined radial width, and a motor shaft through-sleeve 510 extending upward from the center of the aircap upper plate 520 and having a predetermined diameter and height for accommodating insertion of the motor shaft 331 therethrough.

From the bottom of the outer circumference of the aircap upper plate 520 is a cylindrical aircap outer wall 530 that extends a predetermined distance downward, and an aircap inner wall 540 having a diameter smaller than the outer wall 530 is also formed at the bottom of the aircap upper plate 520. An outer chamber 560 formed between the aircap inner and outer walls 540 and 530 and an inner chamber 560 enclosed by the aircap inner wall 540 contain a predetermined amount of air. Accordingly, the air pressure inside the inner and outer chambers 560 and 550 prevents the water level of washing water from rising beyond a certain point within the chambers. In other words, the water level of the washing water storage portion in the sump is different from that in the two chambers 550 and 560.

Here, the number of inner walls 540 of the aircap is not limited to the number in an embodiment of the present invention, and multiple chambers may be created by forming multiple inner walls.

FIG. 5 is an enlarged sectional view showing an aircap that is partially immersed in washing water according to the first embodiment of the present invention.

Referring to FIG. 5, the aircap 500 according to the present invention is installed on top of the sealing case 400 and covers the sealing case 400. The sealing case 400 is completely covered by the inside of the inner wall 540 of the aircap 500. The ends of the aircap's outer and inner walls 530 and 540 are spaced slightly apart from the floor of the sump housing 290. Washing water is allowed to flow through this slight gap.

When washing water enters into the sump housing 290, washing water slowly enters the chambers 550 and 560, where its water level gradually rises. As previously described, the air present inside the chambers 550 and 560 becomes pressurized as the water level of the washing water rises. The water level rises until the pressure of the washing water becomes equal to that of the air. The maximum water level (M) allowed in the chambers 550 and 560 may be set to be lower than the height of sealing case 400.

By setting the water level (H) of the washing water that enters the aircap 500 to be less than the height of the sealing case 400, washing water is prevented from leaking between the sealing case 400 and the sealing cover 410.

Mode for the Invention

FIG. 6 is a perspective view of a wash motor according to a second embodiment of the present invention, and FIG. 7 is a sectional view of the wash motor of FIG. 6 coupled to a sump housing.

Referring to FIGS. 6 and 7, the wash motor 330 having the leakage preventing structure of the present invention includes a motor housing 332 for protecting a stationary member and a rotating member, a bearing portion 334 protruding a predetermined distance upward from the center of the motor housing 332 and having a bearing within, a motor shaft 331 running through the top of the bearing portion to extend substantially therebeyond, and a sealing member 600 coupled to the motor shaft 331 to rest on top of the bearing portion 334. The sealing member 600 is tightly adhered to the inside of the sealing case 400, so that washing water cannot leak between the sealing case 400 and the sealing member 600. The sealing member 600 may be made of a rubber material having a predetermined elasticity.

After the sealing member 600 is coupled to the motor shaft 331, it is inserted into the sealing case 400 formed at the bottom of the sump housing 290. The above method for inserting the sealing member 600 before the motor is installed is much less likely to damage the surface of the sealing member than a method where the sealing member is first installed inside the bottom of the sump housing 290, after which the motor shaft is inserted through the sealing member.

As shown in FIG. 7, the sealing member 600 is installed on the outer bottom portion of the sump housing 290, instead of inside the sump housing 290, thereby facilitating replacement of the sealing member 600. In other words, when the sealing member 600 becomes substantially worn, the wash motor 600 is disassembled from the sump housing 290. Then the worn sealing member 600 is pulled off the motor shaft 331, and replaced with a new one.

INDUSTRIAL APPLICABILITY

The leakage preventing structure of a dishwasher according to the present invention prevents leakage in the dishwasher sump and therefore has a high industrial applicability.

The invention claimed is:

1. A dishwasher, comprising:

a tub for accommodating dishes for washing;

a sump housing receiving water for dishwashing, the sump housing coupled to the bottom of the tub;

a wash motor mounted to the outer bottom surface of the sump housing and having a motor shaft extended into the sump housing by passing through the bottom surface of the sump housing from the wash motor;

a wash pump located within the sump housing, the wash pump including:

a pump case; and an impeller for pumping the water for dishwashing within the pump case, wherein the impeller is connected to an end of the motor shaft;

a sealing case upwardly extended from an inner bottom surface of the sump housing;

a sealing cover fitted within the sealing case and penetrated by the motor shaft; and an air cap covering the sealing case and the sealing cover and penetrated by the motor shaft, wherein the air cap has a space therein for accommodating air, in order to prevent the water for dishwashing from being drawn into the sealing case, and the air cap includes:

an upper plate;

a motor shaft through-sleeve extending upward by a predetermined diameter and height from the upper plate, the motor shaft through surrounding the motor shaft to be in close contact with the outer surface of the motor shaft;

an outer wall extending downward from an edge of the upper plate; and an inner wall extending down ward from the bottom surface of the upper plate, wherein the inner wall is defined within the outer wall by being a predetermined distance away from the outer wall such that a void space is formed between the inner wall and the outer wall.

2. The dishwasher according to claim 1, wherein end portions of the outer wall and the inner wall are respectively a predetermined distance away from the inner bottom surface of the sump housing such that air and the water for washing dishes are drawn into the air cap.

3. The dishwasher according to claim 1, wherein the sealing case is configured to be received in the space defined by the inner wall of the air cap.

4. The dishwasher according to claim 1, wherein the sealing cover is bent downward to be in close contact with the inner bottom of the sump housing, and has a space therein to receive sealing oil.

5. The dishwasher according to claim 4, wherein an inner circumference of the sealing cover, which is in contact with the motor shaft, has a plurality of sealing lips which are firmly pressed to the outer surface of the motor shaft, in order to block off the water for washing into the sealing cover.

* * * * *